US011747123B2

(12) United States Patent
Schmitz et al.

(10) Patent No.: US 11,747,123 B2
(45) Date of Patent: Sep. 5, 2023

(54) ELECTRONIC IGNITION UNIT FOR A STUN GRENADE AND STUN GRENADE

(71) Applicant: Rheinmetall Waffe Munition GmbH, Unterlüß (DE)

(72) Inventors: Jürgen Schmitz, Gifhorn (DE); Knut Krüger, Hermannsburg (DE)

(73) Assignee: Rheinmetall Waffe Munition GmbH, Unterlüß (DE)

( * ) Notice: Subject to any disclaimer, the term of this patent is extended or adjusted under 35 U.S.C. 154(b) by 142 days.

(21) Appl. No.: 17/292,489

(22) PCT Filed: Oct. 30, 2019

(86) PCT No.: PCT/EP2019/079635

§ 371 (c)(1),
(2) Date: May 10, 2021

(87) PCT Pub. No.: WO2020/099131

PCT Pub. Date: May 22, 2020

(65) Prior Publication Data

US 2022/0018643 A1 Jan. 20, 2022

(30) Foreign Application Priority Data

Nov. 14, 2018 (DE) ..... 10 2018 128 485.3

(51) Int. Cl.
*F42C 11/06* (2006.01)
*F42C 11/00* (2006.01)
(Continued)

(52) U.S. Cl.
CPC ..... *F42C 11/003* (2013.01); *F41H 13/0081* (2013.01); *F41H 13/0087* (2013.01);
(Continued)

(58) Field of Classification Search
CPC .. F41H 13/00; F41H 13/0081; F41H 13/0087; F42B 12/36; F42B 12/42;
(Continued)

(56) References Cited

U.S. PATENT DOCUMENTS 3,953,804 A 4/1976 Dethlefsen et al.
4,947,753 A 8/1990 Nixon, III
(Continued)

FOREIGN PATENT DOCUMENTS

DE 23 56 875 B2 12/1976
DE 2945122 A1 5/1980
(Continued)

OTHER PUBLICATIONS

International Search Report from corresponding PCT Application PCT/EP2019/079635, dated Dec. 18, 2019.

*Primary Examiner* — James S Bergin
(74) *Attorney, Agent, or Firm* — Harness, Dickey & Pierce, P.L.C.

(57) ABSTRACT

The invention relates to an electronic ignition unit for a stun grenade, comprising at least one energy source, at least one igniter, at least one control device, wherein the electronic ignition device further comprises an igniter driver connected to the at least one energy source and to the at least one control device.

11 Claims, 6 Drawing Sheets

(51) Int. Cl.

| | |
|---|---|
| ***F42B 12/42*** | (2006.01) |
| ***F42B 27/00*** | (2006.01) |
| ***F42C 14/02*** | (2006.01) |
| ***F42B 12/36*** | (2006.01) |
| ***F42C 19/08*** | (2006.01) |
| ***F41H 13/00*** | (2006.01) |

(52) U.S. Cl.
CPC ..... *F42B 12/36* (2013.01); *F42B 12/42* (2013.01); *F42B 27/00* (2013.01); *F42C 11/06* (2013.01); *F42C 14/02* (2013.01); *F42C 14/025* (2013.01); *F42C 19/08* (2013.01); *F42C 19/0842* (2013.01)

(58) Field of Classification Search
CPC ..... F42B 27/00; F42B 30/04; F42C 11/00; F42C 11/003; F42C 11/06; F42C 14/02; F42C 14/025; F42C 15/42; F42C 19/08; F42C 19/0842; F42C 15/40
USPC ..... 102/487
See application file for complete search history.

(56) References Cited

U.S. PATENT DOCUMENTS

| | | | | |
|---|---|---|---|---|
| 5,497,704 | A * | 3/1996 | Kurschner | F42C 11/06 102/215 |
| 6,166,451 | A | 12/2000 | Pigott | |
| 7,197,983 | B2 | 4/2007 | Barth et al. | |
| 8,065,960 | B2 * | 11/2011 | Grosch | F42C 15/42 102/482 |
| 9,016,888 | B2 | 4/2015 | Glynn et al. | |
| 11,385,030 | B2 * | 7/2022 | Hoelzl | F41H 13/0087 |
| 2006/0230972 | A1 | 10/2006 | Ouliarin | |
| 2015/0028602 | A1 | 1/2015 | Shimizu et al. | |
| 2019/0285392 | A1 * | 9/2019 | Black | F41H 13/0087 |
| 2021/0254937 | A1 * | 8/2021 | Hoelzl | F41A 33/02 |

FOREIGN PATENT DOCUMENTS

| | | | | |
|---|---|---|---|---|
| DE | 694 16 503 | T2 | 9/1999 | |
| DE | 697 12 109 | T2 | 10/2002 | |
| DE | 10 2005 035 580 | B3 | 1/2007 | |
| DE | 102010052209 | A1 | 5/2012 | |
| DE | 202012002149 | U1 | 7/2012 | |
| DE | 102016111947 | A1 | 1/2018 | |
| EP | 661516 | A1 * | 7/1995 | F42C 11/06 |
| EP | 1287307 | B1 | 8/2005 | |
| EP | 3023730 | A1 | 5/2016 | |
| EP | 3023731 | A1 | 5/2016 | |
| WO | WO-2012069120 | A1 | 5/2012 | |
| WO | WO-2014066917 | A1 | 5/2014 | |

* cited by examiner

ELECTRONIC IGNITION UNIT FOR A STUN GRENADE AND STUN GRENADE

CROSS-REFERENCE TO RELATED APPLICATIONS

This application is a national phase application of PCT Application No. PCT/EP2019/079635, filed on 30 Oct. 2019, which claims the benefit of and priority to German Patent Application No. 10 2018 128 485.3, filed on 14 Nov. 2018. The entire disclosures of the applications identified in this paragraph are incorporated herein by references.

FIELD

The invention relates to an electronic ignition unit for a stun grenade, comprising at least one energy source, at least one igniter, each of which is assigned to a pyrotechnic charge, and at least one control device.

The invention also relates to a stun grenade having such an electronic ignition unit.

BACKGROUND

Stun grenades (so-called sound and flash stun grenades) such as sound and flash projectiles are non-lethal deflectors having a flash/explosion sound effect. These are used in liberation campaigns by police tactical units (SEKs) and police units. Throwing the stun grenade and the effects caused by the stun grenade render a combatant or similar person incapable of action for a short time. During this period, the units can gain access. As an alternative to throwing, the stun grenade can also be shot.

Classic sound and flash stun grenades substantially consist of a flash charge and/or an explosion sound charge, an igniter, a safety device, and a delay device which ensures a delay of a specific time between the fuse and the ignition. Such a simple stun grenade that produces an explosion sound and a flash is known from U.S. Pat. No. 4,947,753 B.

A two-part pyrotechnic stun grenade is known from DE 10 2010 052 209 A1.

If a multiple explosion sound or flash effect is to be produced, a plurality of delay lines are required which, depending on the configuration, are triggered synchronously or asynchronously according to a defined pattern. Such settings are implemented mechanically via defined lengths of the pyrotechnic delay lines. Changes to the delay times are no longer possible after production. Such multiple stun grenades are known from US 2015/028602 A1 or from WO 2012/069120 A1. Conventional stun grenades having mechanical-pyrotechnic fuses allow a delayed ignition of a plurality of explosion sound or flash charges in succession. The ignition order and also the time interval are, however, predetermined and usually given by the construction.

U.S. Pat. No. 7,197,983 B2 discloses a mechano-electrical fuse for a hand grenade. By activating the fuse, a pretensioned spring is released and drives a generator via a shaft. The generator produces electrical energy that delays a detonator and uses it to ignite the hand grenade.

Electronic stun grenades are also known. However, these show a reduced brightness and volume intensity. EP 3 023 730 A1 discloses an electronic stun grenade for emitting a brief light pulse. The stun grenade comprises a housing having a plurality of illuminants, an energy store for supplying energy to the illuminants, and a control device via which the illuminants can be controlled.

U.S. Pat. No. 9,016,888 B2 describes a fully electronic grenade which comprises lighting means for producing a flash and loudspeakers for generating an explosion sound.

Such electronic grenades usually have a control that directly controls the respective lighting means and the loudspeakers or sound generators. The disadvantage in this case is that the light pulses that can be produced are limited in their brightness and the noise that can be generated are limited in its volume, so that the stun effect is not sufficiently great.

US 2006/0230972 A1 discloses a sound and flash stun grenade having an electronic ignition unit. The grenade has one single pyrotechnic stun charge. Furthermore, the grenade can have a device for producing a sound, such as a loudspeaker or a gas-operated whistle. However, the grenade described has only one single pyrotechnic charge and the ignition unit is only configured to ignite one single pyrotechnic charge.

DE 20 2012 002 149 U1 discloses a stun grenade having an electronic ignition unit. The stun device has a plurality of pyrotechnic stun charges. The stun device also has a control device, the outputs of which are directly connected to the fuses. The disadvantage in this case is that the number of outputs and the ignition currents are limited by the control device.

Proceeding from this, the invention is based on the object of providing an improved electronic ignition unit for a stun grenade.

SUMMARY

This object is achieved by the electronic ignition unit of claim 1.

Advantageous embodiments and developments are the subject of the respective dependent claims.

According to claim 1, an electronic ignition unit for a stun grenade is provided. The electronic ignition unit comprises at least one energy source, at least one, preferably at least two, igniters, and at least one control device. According to the invention, the electronic ignition unit comprises at least one igniter driver connected to the at least one energy source and to the at least one control device.

Furthermore, according to the invention, a stun grenade is provided which comprises such an electronic ignition unit or, as described below, a further developed electronic ignition unit. The electronic ignition unit is preferably arranged on or in the head of the stun grenade. However, the electronic ignition unit can also be arranged on or in the bottom of the stun grenade. For this purpose, the ignition unit can, for example, be part of a modular stun grenade. However, it is also conceivable that the ignition unit is arranged in the interior of the stun grenade.

Because the electronic ignition device has an igniter driver, it is now possible to control the at least one igniter, preferably the at least two igniters, in various ways. It is possible in this case for the at least one igniter driver to output different currents and voltages for the/each igniter. In particular, large voltages and currents can also be converted which cannot be converted directly by the at least one control device. Furthermore, at least one energy source can also be used which provides a large amount of electrical power. Such a large electrical power can be selectively passed on via the igniter driver(s) to the individual igniter(s) and trigger it/them. According to the invention, an optimal configuration between an effect such as flash, explosion sound, and the control thereof can be achieved. The at least one control device and thus also the electronic ignition unit can be freely adjusted electronically, so that any desired sequence of effects can be implemented. The possibility of using different pyrotechnic charges means that a wide variety of stun events can be implemented.

The igniter driver is preferably an electrical or electronic igniter driver.

The igniter driver is preferably designed as a squib driver. Squib drivers are known and are, for example, from the company Texas Instruments.

The igniter driver is preferably arranged operationally between the at least one control device and the at least one igniter. The at least one control device is preferably configured to control the at least one igniter via the igniter driver.

The at least one igniter is preferably a so-called squib. The at least one igniter can preferably be designed as an electric match.

The energy source can be an energy supply based on batteries, power generators (e.g. with manual operation, induction motor, inductive charging of a capacitance/inductance), or capacitors. The energy source is designed in such a way that it supplies a sufficiently large current and a sufficiently high voltage to ignite the igniter. The at least one energy source is an energy store such as supercapacitors (ultracaps) for providing an energy store with high power densities or batteries, such as a LiSOCl battery for providing energy stores with high energy densities.

The at least one control device is preferably designed as a circuit board and has a CPU, such as a microcontroller, a field programmable gate array (FPGA), or the like. This can also be operated by the energy sources provided and can be configured to control various functions. For example, the at least one control device can be designed to control ignition times of the respective igniters. Furthermore, the at least one control device can be designed to provide a fuse and supply for the ignition circuits and/or the igniter driver.

In addition, the at least one control device can be configured to check the energy supply.

Furthermore, the at least one control device can be configured to communicate via an interface with a terminal for programming the at least one control device. The at least one control device can preferably trigger the at least one igniter via the at least one igniter driver on the basis of this programming.

It can also be provided that an ignition sequence or a scenario for igniting the at least two igniters and thus also the pyrotechnic charges connected thereto can be programmed via such an interface. For example, it can be provided in an embodiment that multiple-synchronous effects or multiple-asynchronous effects can be programmed.

Any sequence of effects can also be programmed. Furthermore, the at least one control device can be designed to determine the state of the electronic ignition device and a stun grenade connected thereto via the interface.

The at least one control device can be programmed in one embodiment by means of at least one adjusting ring or switch arranged on the stun grenade.

Furthermore, the at least one control device can be programmed via the interface. The interface can be connected to a terminal via a line or a cable (e.g., USB, Firewire, etc.).

To trigger the stun grenade, it can have a lever which interacts with the electronic ignition unit in such a way that it initiates a triggering process.

In one embodiment, the at least one igniter is connected to the igniter driver via a channel. A channel is understood to mean a separate electrical connection.

The igniters are preferably each connected to the igniter driver via their own channel; i.e. a separate electrical connection.

This means that each igniter can be controlled separately with a specific predefined voltage and with a specific predefined current. In order to ignite the igniter electronically and to apply a typical ignition current, an igniter driver is preferably designed as a driver stage. For this purpose, the igniter driver can have a channel for each igniter, to which a different ignition current is applied. The driver stage can be constructed discretely and comprise bipolar and/or field effect transistors or else be designed as an integrated circuit on a circuit board. There is also the possibility that the driver stage includes safety functions. Typical individual currents can be in the range of 0.1 A for so-called A-fuses, in the range of 1 A for so-called U-fuses, and in the range of 10 A for so-called HU-fuses. It is also possible for all of the aforementioned different igniters to be connected to a driver stage, which can be triggered by the driver stage with different igniter currents, for example between 0.1 A and 10 A.

Provision can preferably be made to control the igniters separately via the igniter driver. This makes it possible for each igniter to be triggered individually and thus also for each pyrotechnic charge to be ignited individually.

It can preferably be provided that the at least one control device is configured to control the ignition time of the at least one igniter. Furthermore, it can be provided that the at least one control device is configured to individually control the ignition times of the respective igniters. This makes it possible for different ignition sequences and ignition scenarios to be implemented by the at least one control device.

In one embodiment of the electronic ignition unit, it can be provided that the electronic ignition unit has at least one radio interface which is preferably operationally connected to the at least one control device, and that the at least one control device is configured to trigger the at least one igniter immediately or with a delay in response to a signal received from the radio interface.

In one embodiment of the electronic ignition unit, it can be provided that the electronic ignition unit has at least one radio interface which is operationally connected to the at least one control device, and that the at least one control device is configured to trigger the at least two igniters immediately and/or with a delay in response to a signal received from the radio interface.

"Time-shifted" can mean that the igniter(s) are triggered with a time delay relative to the triggering event and/or with a delay to one another.

The at least one control device can be programmed via the radio interface using an external programming device or a terminal (such as a smartphone, a tablet, a PDA, a mobile computer). The terminal can be part of a system. It can also be provided that the at least one control device is designed to communicate with a further electronic ignition device of a further stun grenade via the radio interface. Alternatively and/or in addition to the radio interface, an optical interface can be formed.

Furthermore, it can be provided that the electronic ignition unit comprises at least one sensor operationally connected to the at least one control device, and the at least one control device is configured to trigger the at least one igniter immediately or with a delay in response to a state or value detected by the sensor.

If the ignition device has at least two igniters, it can be provided that the electronic ignition unit comprises at least one sensor operationally connected to the at least one control device, and the at least one control device is configured to trigger the at least two igniters immediately and/or with a delay in response to a state or value detected by the sensor.

The sensor can be, for example, a motion sensor, a temperature sensor, a sound sensor, a pressure sensor, a brightness sensor, a shock sensor, and/or an acceleration sensor. A combination of the aforementioned sensors can also be formed.

If the ignition unit has at least two igniters, it can also be provided that the electronic ignition unit has at least one position detection device, and the at least one control device is configured to trigger the at least one or more igniters immediately and/or with a delay when a specific position is reached.

If the ignition device has at least two igniters, it can be provided that the electronic ignition unit at least one position detection device, and the at least one control device is configured to trigger the at least two igniters immediately and/or with a delay when a specific position is reached.

In an embodiment of the stun grenade, the stun grenade can have at least one pyrotechnic charge, each igniter being assigned to one pyrotechnic charge in each case. The pyrotechnic charges are preferably light, flash, and/or explosion sound charges.

Furthermore, according to one further aspect, a system can be provided which comprises at least two stun grenades as described above. The system can furthermore comprise the terminal.

In one development of the system, it can be provided that the terminal is configured to communicate with the electronic ignition unit of each stun grenade via the interface and/or the radio interface.

It can further be provided that the at least one control device of each electronic ignition unit of each stun grenade is/are programmable via the terminal.

Furthermore, the system can provide in one development that the at least one control device of each electronic ignition unit of each stun grenade can be controlled via the terminal in order to trigger, immediately and/or with a delay, the at least one pyrotechnic charge of the at least one stun grenade individually or in combination with other stun grenades.

It is also possible that the radio interface of a stun grenade (master stun grenade) is used to transmit a signal to other stun grenades (slave stun grenades) via the radio interfaces thereof in order to trigger them.

BRIEF DESCRIPTION OF THE DRAWINGS

The invention is to be explained below by way of example based on embodiments with reference to the drawings.

In the drawings.

DETAILED DESCRIPTION

Figure 1:
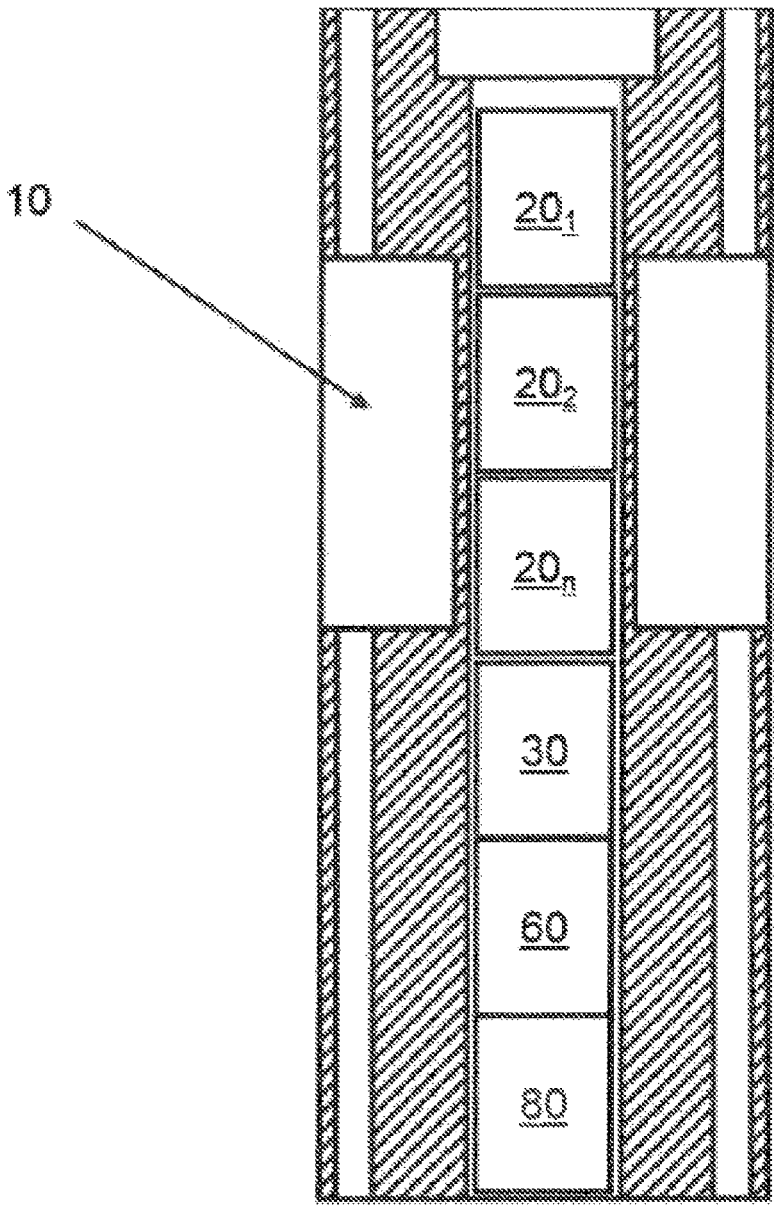
FIG. 1 is a schematic representation of an electronic ignition unit according to the invention in accordance with one embodiment.

FIG. 1 shows an electronic ignition unit 10 for a stun grenade. The ignition unit 10 comprises at least one energy source 201, 202, **20*n*. In the embodiment shown in FIG. 1, these are three energy sources 201, 202, 20*n*. However, the number of energy sources 201, 202, 20*n* can also be different from three. In the case of the energy sources 201, 202, 20*n* shown in FIG. 1, it is an energy store such as supercapacitors (ultracaps) for providing an energy store with high power densities or batteries, such as a LiSOCl battery for providing energy stores with high energy densities. At least one igniter driver 30 is connected to the at least one energy source 201, 202, 20*n***.

The electronic ignition unit 10 further comprises at least two igniters 701, 702, **70*n* which are each assigned to a pyrotechnic charge. The igniters 701, 702, 70*n*** are used to trigger or ignite the pyrotechnic charge.

The electronic ignition unit 10 also has a control device 60. According to one embodiment, the control device 60 is preferably designed as a microcontroller on a printed circuit board.

Furthermore, the electronic ignition unit 10 has at least one igniter driver 30. The igniter driver 30 is connected to the control device 60 and is controlled by the control device 60. The igniter driver 30 also has a plurality of channels 751, 752, **75*n*. This number of channels 751, 752, 75*n* preferably corresponds to the number of igniters 701, 702, 70*n* so that the igniters 701, 702, 70*n* are connected in each case to the igniter driver 30 via its own channel 751, 752, 75*n***.

The control device 60 is configured to control the igniter 701, 702, **70*n* separately via the igniter driver 30. The control device 60 is configured to control the ignition times of the respective igniters 701, 702, 70*n*** individually.

According to the embodiment shown in FIG. 1, the electronic ignition unit 10 has at least one radio interface 80 operationally connected to the control device and the control device 60 is configured to trigger the igniter 701, 702, **70*n* immediately or with a delay via the igniter driver in response to a signal received from the radio interface 80**.

In one embodiment, it can also be provided that the electronic ignition unit 10 has at least one position detection device 90 and at least one sensor 100. The sensor 100 is a sensor 100 that is operationally connected to the control device 60, and the control device 60 is configured to trigger the igniter 701, 702, **70*n* either immediately or with a delay in response to a state or value detected by the sensor 100. The position detection device 90 is also operationally connected to the control device 60. The control device 60 is configured to be triggered immediately or with a delay with one or more igniters 701, 702, 70*n*** when a specific position is reached.

The embodiment shown in FIG. 1 shows an electronic ignition unit which can be integrated into the stun grenade.

Figure 2:
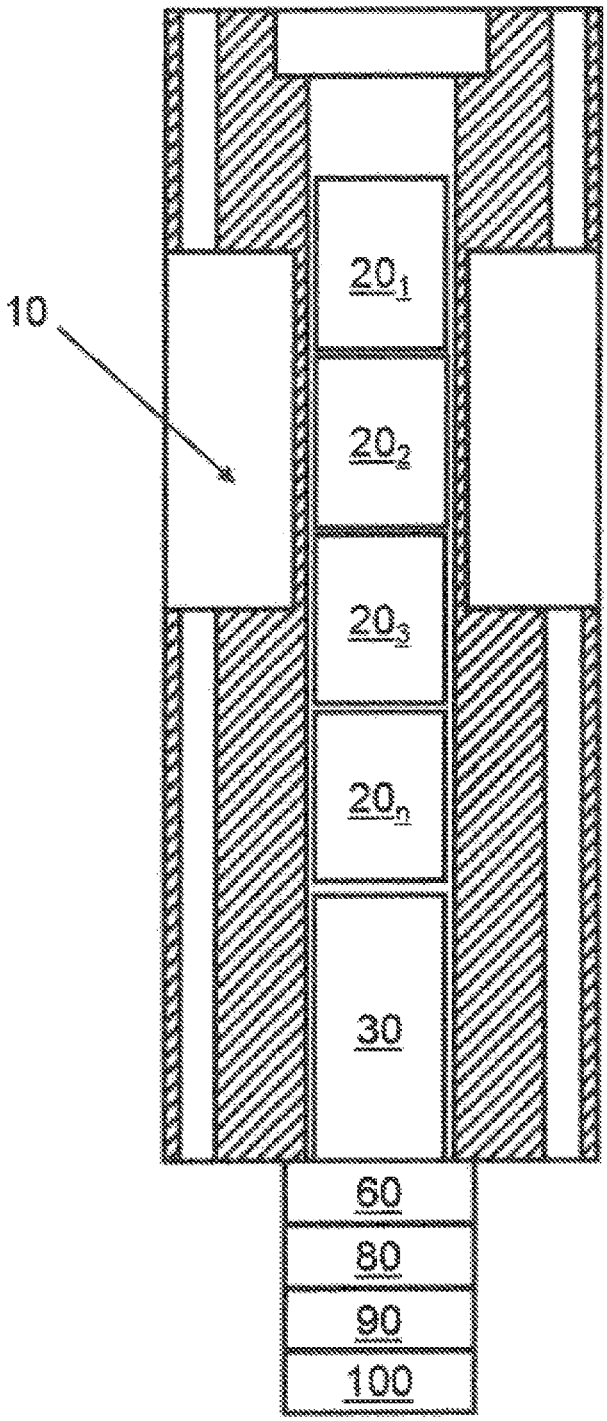
FIG. 2 is a schematic representation of an electronic ignition unit according to the invention in accordance with one further embodiment.

The embodiment of the electronic ignition unit 10 shown in FIG. 2 is a configuration which can be attached to the underside of a stun grenade as an attachment variant or as a screw-on variant. Accordingly, additional electronic modules can be formed on the underside of the electronic ignition unit, as described below. However, the embodiment shown in FIG. 2 substantially corresponds to the embodiment according to FIG. 1, only the differences between the two embodiments being presented below.

According to the embodiment shown in FIG. 2, the electronic ignition unit 10 has at least one energy source. In the embodiment shown in FIG. 1, these are four energy sources 201, 202, 203, 20*n*. However, the number of energy sources 201, 202, 203, 20*n* can also be different from four.

The control device 60 is formed on a separate circuit board. The electronic ignition unit 10 further comprises a radio interface 80 which is formed on a separate circuit board. In addition, the electronic ignition unit 10 has at least one position detection device 90. Furthermore, the electronic ignition unit 10 has at least one sensor 100 which is formed on a separate circuit board.

Figure 3:
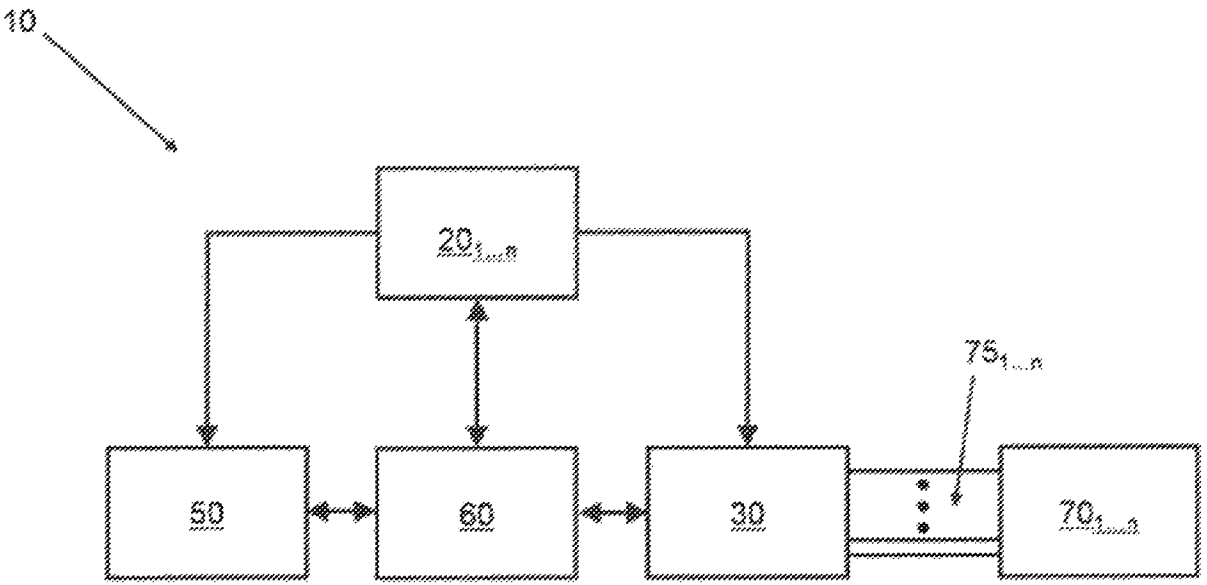
FIG. 3 is a schematic representation of the control of the electronic ignition unit according to FIG. 1 and according to FIG. 2.

FIG. 3 shows again schematically the structure of the above-described embodiments of the electronic ignition unit 10. The electronic ignition unit 10 has a control device 60 at least one energy source 201 . . . n, an igniter driver 30, and preferably an interface 50. The interface 50 can, for example, be designed to be connected via cables. The at least one energy source 201 . . . n is connected to the interface 50 of the control device in order to supply it with energy. Furthermore, the at least one energy source 201 . . . n is connected to the igniter driver 30 in order to supply it with energy and to transmit energy to the igniter via the individual channels 751 . . . n. The control device 60 is operationally connected to the igniter driver 30 in order to control the latter. Furthermore, the control device 60 is operationally connected to an interface 50.

As already stated above, the control device 60 is configured to control the igniter 701, 702, 70*n* separately via the igniter driver 30. This allows for the individual igniters 701, 702, 70*n* to implement specific ignition sequences. Two of these ignition sequences are shown by way of example in FIGS. 4 and 5.

Figure 4:
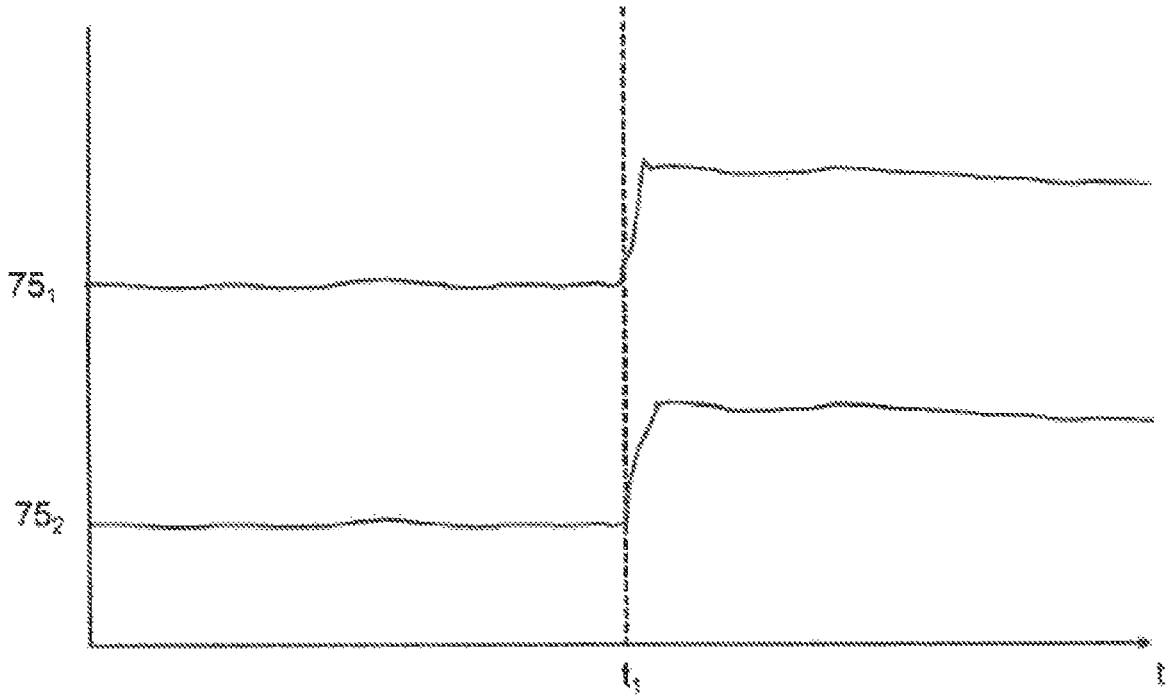
FIG. 4 is a schematic representation of an ignition sequence of the ignition unit according to the invention.

FIG. 4 shows a synchronous ignition of two igniters 701, 702, via the channels 751 and 752. The ignition of the two channels 751 and 752 takes place at a common point in time t1. This can cause a particularly strong stun event, for example, or different pyrotechnic charges can be ignited at the same time, which have different effects.

Figure 5:
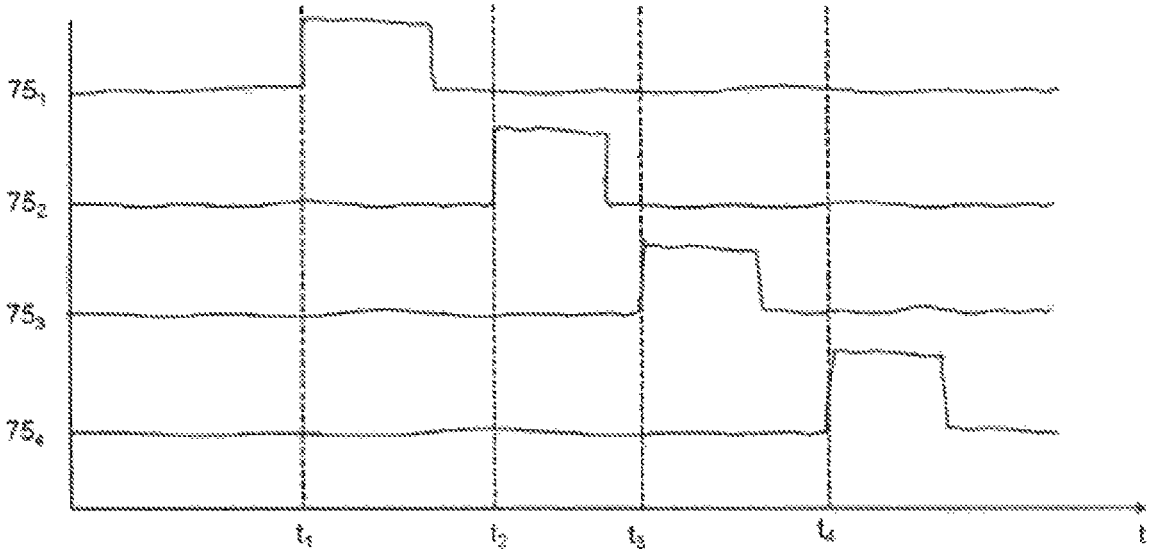
FIG. 5 is a further schematic representation of an ignition sequence of the ignition unit according to the invention.

FIG. 5 shows a sequential ignition of four igniters 701, 702, 703, 704 via four channels 751, 752, 753, 754. The four channels 751, 752, 753, 754 are ignited at different times t1, t2, t3, t4. In this way, for example, a particularly long-lasting stun event can be caused in which the individual pyrotechnic charges are ignited in sequence with a delay, in succession, or one after the other.

Figure 6:
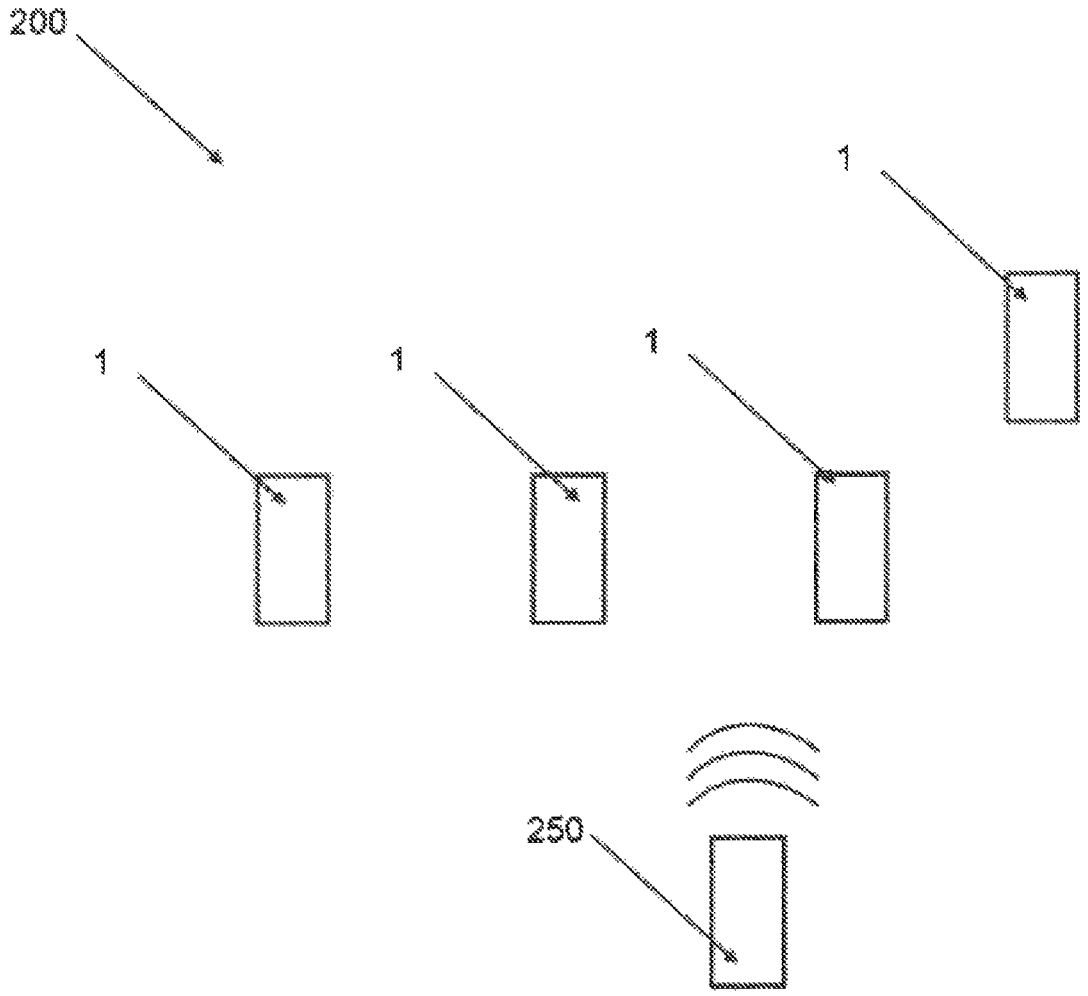
FIG. 6 is a schematic representation of a system which comprises at least one stun grenade according to the invention.

FIG. 6 shows a system 200 comprising at least one stun grenade 1. The system further comprises at least one terminal 250. The terminal 250 is configured to communicate with the electronic ignition unit 10 of each stun grenade 1 via the interface 50 and/or the radio interface 80. The control device 60 of each electronic ignition unit 10 of each stun grenade 1 can be programmed via the terminal 250. The control device 60 of each electronic ignition unit 10 of each stun grenade 1 can be controlled via the terminal 250 in order to trigger, immediately and/or with a delay, the at least one pyrotechnic charge of the at least one stun grenade 1 individually or in combination with other stun grenades 1.

Although the above description of the drawings describes an electronic ignition unit, this disclosure also expressly relates to a stun grenade which comprises such an ignition unit as disclosed in all of the embodiments described above.

LIST OF REFERENCE SIGNS

1 Stun grenade
10 Ignition unit
201, 202, 20*n* Energy source
30 Igniter driver
50 Interface
60 Control device
70 Igniter
80 Radio interface
90 Sensors
100 Position detection
200 System
250 Terminal

What is claimed is:

1. An electronic ignition unit for a stun grenade, the electronic ignition unit comprising:
at least one energy source;
at least two igniters;
at least one control device; and
an igniter driver connected to the at least one energy source and to the at least one control device, the igniter driver configured to transmit power from the at least one energy source to each igniter of the at least two igniters;
wherein said each igniter is connected to the igniter driver via its own channel, and wherein the control device is configured to control said each igniter separately via the igniter driver.

2. The electronic ignition unit according to claim 1, wherein the at least one control device is configured to control an ignition time of the at least two igniters.

3. The electronic ignition unit according to claim 1, wherein the at least one control device is configured to control ignition times of the respective igniters individually.

4. The electronic ignition unit according to claim 1, further comprising at least one radio interface connected to the at least one control device, wherein the at least one control device is configured to trigger one of the at least two igniters immediately or with a delay in response to a signal received from the radio interface.

5. The electronic ignition unit according to claim 1, further comprising at least one radio interface connected to the at least one control device, wherein the at least one control device is configured to trigger the at least two igniters immediately and/or with a delay in response to a signal received from the radio interface.

6. The electronic ignition unit according to claim 1, further comprising at least one sensor connected to the at least one control device, wherein the at least one control device is configured to trigger one of the at least two igniters immediately or with a delay in response to a state or value detected by the sensor.

7. The electronic ignition unit according to claim 1, further comprising at least one sensor connected to the at least one control device, wherein the at least one control device is configured to trigger the at least two igniters immediately and/or with a delay in response to a state or value detected by the sensor.

8. The electronic ignition unit according to claim 1, further comprising at least one position detection device, wherein the at least one control device is configured to trigger one of the at least two igniters immediately or with a delay when a specific position is reached.

9. The electronic ignition unit according to claim 1, further comprising at least one position detection device, wherein the at least one control device is configured to trigger the at least two igniters immediately and/or with a delay when a specific position is reached.

10. A stun grenade comprising an electronic ignition unit according to claim 1.

11. The stun grenade according to claim 10, wherein the stun grenade has at least one pyrotechnic charge, each igniter being assigned to a pyrotechnic charge in each case, and/or the at least one pyrotechnic charge being flash and/or explosion sound charges.

* * * * *